United States Patent [19]

Ryno

[11] Patent Number: 4,978,293

[45] Date of Patent: Dec. 18, 1990

[54] NOZZLE MIX, OPEN POWER BURNER

[75] Inventor: Robert W. Ryno, El Paso, Tex.

[73] Assignee: A. O. Smith Corporation, Milwaukee, Wis.

[21] Appl. No.: 382,440

[22] Filed: Jul. 19, 1989

[51] Int. Cl.[5] ..... F23Q 7/06

[52] U.S. Cl. ..... 431/258; 431/187; 431/177; 431/265; 431/351

[58] Field of Search ..... 431/265, 187, 258, 351, 431/177, 354, 188

[56] References Cited

U.S. PATENT DOCUMENTS

| | | | |
|---|---|---|---|
| 1,953,483 | 4/1934 | Higinbothan | 431/265 |
| 3,469,790 | 9/1969 | Duncan | 431/265 |
| 3,542,501 | 11/1970 | Stanmore et al. | 431/258 |
| 3,820,943 | 6/1974 | DeLancey et al. . | |
| 4,383,820 | 5/1983 | Camacho | 431/265 |
| 4,424,793 | 1/1984 | Cooperrider . | |
| 4,595,355 | 6/1986 | Garrelfs et al. | 431/265 |
| 4,622,811 | 11/1986 | Distel et al. | 431/258 |
| 4,723,513 | 2/1988 | Vallett et al. . | |
| 4,728,284 | 3/1988 | Coppin | 431/188 |
| 4,793,800 | 12/1988 | Vallett et al. . | |
| 4,842,509 | 6/1989 | Hasenack | 431/187 |

FOREIGN PATENT DOCUMENTS

| | | | |
|---|---|---|---|
| 129315 | 8/1982 | Japan | 431/351 |

OTHER PUBLICATIONS

"Installation and Service Instructions for the Economite Conversion Gas Burners—Models 400-33, F400-33, 800-33, F88-33" by Midco International Inc., 12 pages; date unknown.

*Primary Examiner*—Carroll B. Dority

*Attorney, Agent, or Firm*—Andrus, Sceales, Starke & Sawall

[57] ABSTRACT

A nozzle mix, open power burner includes an air housing for receiving pressurized air from a blower. A flame retention plate including a plurality of openings therein is adapted for placement at the outlet of the air housing, so that air supplied to the housing is outletted therefrom through the flame retention plate openings. A gas tube extends through the air housing and includes a gas discharge outlet downstream of the flame retention plate. Gas is discharged from the gas outlet in a direction radially outwardly relative to the longitudinal axis of the gas tube, so that gas is discharged into the flow path of air passing through the flame retention plate. A hot surface igniter is provided downstream of the flame retention plate for igniting the mixed gas and air.

3 Claims, 2 Drawing Sheets

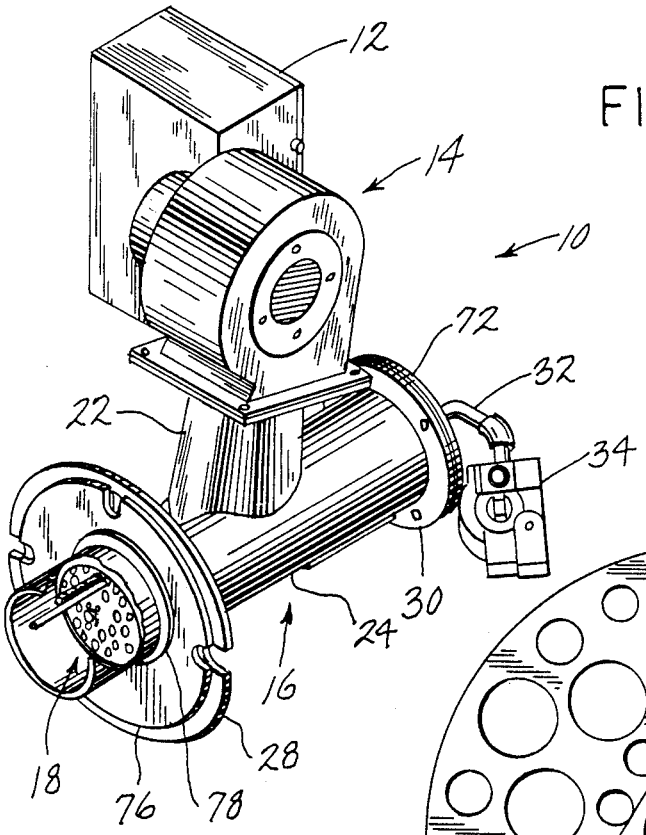
FIG. 1
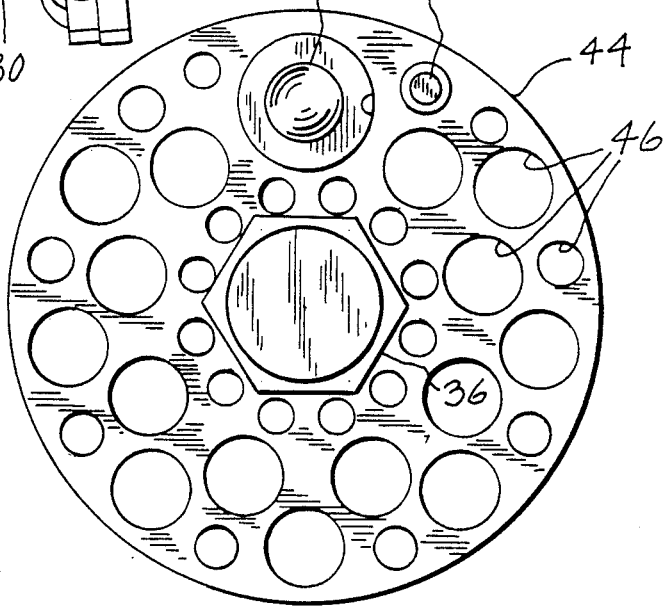
FIG. 4
FIG. 3
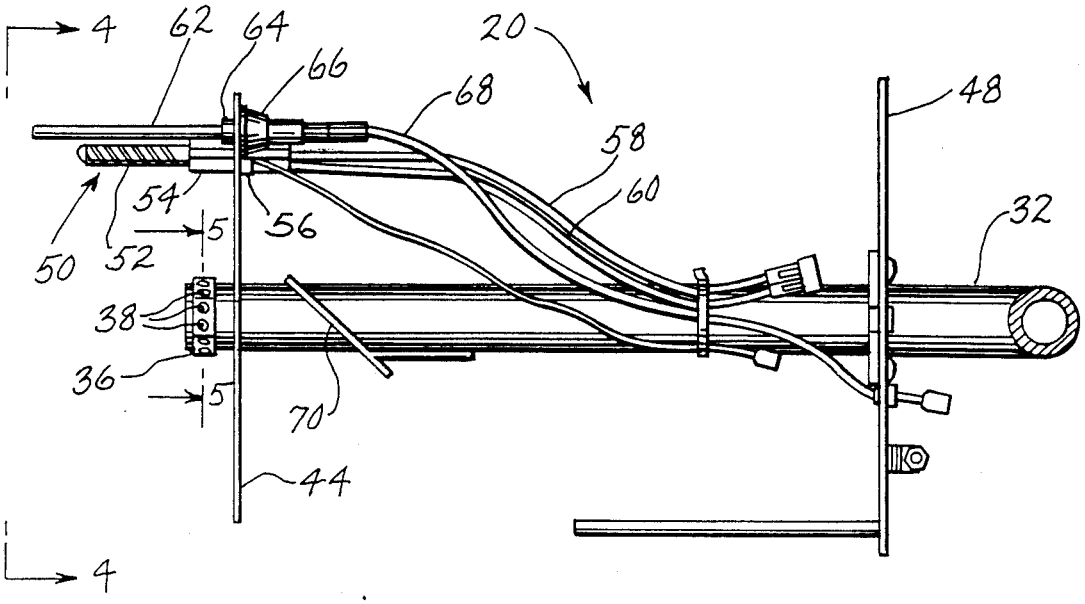

NOZZLE MIX, OPEN POWER BURNER

BACKGROUND AND SUMMARY

This invention relates to a power gas burner, such as for use in a water heater or other appliance.

Various power gas burner assemblies are known, and two such assemblies are shown in U.S. Pat. Nos. 3,820,943 and 4,424,793. In these patents, primary air is mixed with gas at a point upstream of a flame retention head or plate. U.S. Pat. No. 3,820,943 discloses a pilot flame assembly, also located upstream of the flame retention plate, for igniting mixed gas and primary air prior to its discharge radially outwardly onto the outer surface of the plate, where the ignited gas and primary air then mixes with secondary air passing through the plate. U.S. Pat. No. 4,424,793 shows gas mixing with primary air in the throat of a venturi, which has its outlet disposed at the center of the flame retention plate. A spark igniter ignites the primary air-fuel mixture near the plate, whereafter the ignited mixture propogates outwardly and mixes with secondary air passing through the flame retention plate downstream thereof.

Various other burner structures are known in which gas is mixed with primary air in a chamber, which is in communication with a main burner casting disposed within a nozzle. A pilot assembly is provided adjacent the main burner casting for igniting the mixed gas and primary air upon discharge from the main burner casting. Secondary air passes through the nozzle surrounding the main burner casting and mixes with the ignited gas and primary air downstream of the nozzle.

The present invention provides a power gas burner of simple construction which provides a high degree of safety during operation. In accordance with the invention, a power gas burner assembly includes a housing having an air inlet and an air outlet, and a blower for providing pressurized air to the air inlet. A plate is adapted for placement at the air outlet, and includes a plurality of openings formed therein for outletting air from the housing. Gas supply means includes a gas outlet disposed downstream of the plate, so that gas discharged therethrough is mixed with air passing through the openings in the plate at a location downstream of the plate. Ignition means is located downstream of the plate for igniting mixed air and gas. With this construction, there is no pre-mixing of air and gas at a location upsteam of the plate, thereby avoiding flame flashback through the plate. In a preferred embodiment, the gas supply means comprises a gas tube extending through the housing and through the plate, with the plate acting to maintain the gas tube in position relative to the housing. The housing preferably comprises a tubular member with the air inlet located in a side thereof, with one end of the tubular member comprising the air outlet and the other end of the tubular member being substantially sealed. The gas tube preferably extends through the other end of the tubular member, and a mounting plate is adapted for placement thereat for fixing the position of the gas tube relative to the tubular housing. The gas outlet of the gas supply means preferably includes diverter means for diverting the direction of flow of the gas discharged through the gas outlet. The diverter means preferably comprises an orifice member having a plurality of passages therethrough for discharging gas radially outwardly into the flow path of air passing through the openings in the plate for mixing the gas with air. The ignition means preferably comprises a hot surface igniter disposed within the flow path of mixed air and gas downstream of the plate for igniting the mixture. The hot surface igniter is preferably mounted to the plate.

BRIEF DESCRIPTION OF THE DRAWINGS

The drawings illustrate the best mode presently contemplated of carrying out the invention.

In the drawings:

FIG. 1 is an assembled isometric view of the nozzle mix, open power burner of the invention;

FIG. 3 is a side elevation view, partially in section, of an ignition assembly for the power burner of FIG. 1;

FIG. 4 is a front elevation view of the ignition assembly of FIG. 3, reference being made to line 4—4 of FIG. 3.

DETAILED DESCRIPTION OF THE PREFERRED EMBODIMENT

Figure 2:
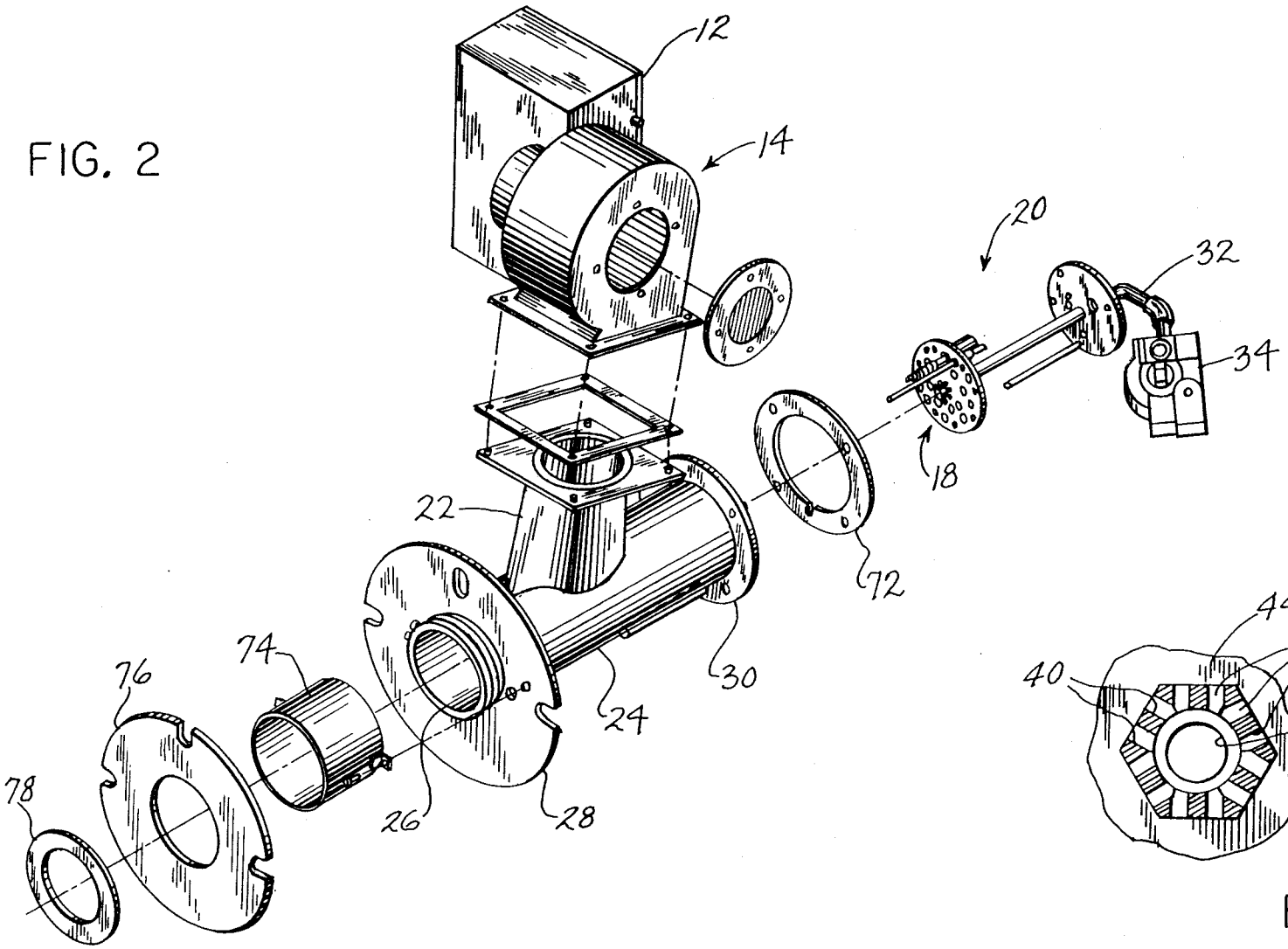
FIG. 2 is an exploded isometric view showing the disassembled components of the burner of FIG. 1.

As shown in FIG. 1, a power gas burner assembly 10 includes a control box 12, a motor and blower assembly 14, a power burner housing 16 and an ignition assembly including a burner head assembly 18. With reference to FIG. 2, it is seen that burner head assembly 18 is mounted at the forward end of the ignition assembly, shown generally at 20.

Blower 14 supplies pressurized air through its outlet to an air duct 22, which communicates the pressurized air to the interior of air tube 24 associated with housing 16. Air tube 24 includes a discharge outlet 26 (FIG. 2). A flange 28 is provided about the outer surface of air tube 24 adjacent outlet 26. A plate 30 is mounted to the other end of air tube 24.

Figure 5:
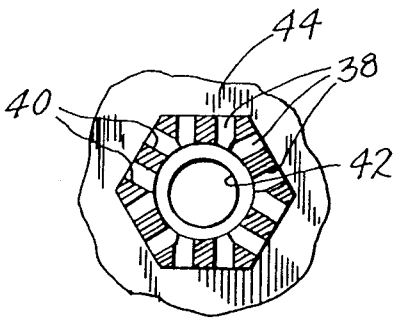
FIG. 5 is a partial sectional view taken generally along line 5—5 of FIG. 3.

As shown in FIGS. 2 and 3, a gas tube 32 is adapted to receive gas through a gas valve, shown at 34. An orifice member 36 is connected to the discharge end of gas tube 32, and includes a series of gas discharge orifices, shown at 38. With reference to FIG. 5, orifices 38 comprise the outlet of a series of passages 40 formed in orifice member 36, which extend between orifices 38 and the internal passage 42 of gas tube 32 for discharging gas thereform. The longitudinal axes of passages 40 are disposed substantially perpendicular to the longitudinal axis of gas tube passage 42, so that gas passing through gas tube passage 42 is diverted through passages 40 to a flow direction substantially perpendicular to the direction of flow through passage 42 upon discharge.

A flame retention plate 44 is mounted to the forward end of gas tube 32. Flame retention plate 44 includes a central opening through which gas tube 32 extends, such that the discharge of gas through orifices 38 is downstream of flame retention plate 44. With reference to FIG. 3, flame retention plate 44 is provided with a series of openings 46 therethrough.

A burner mounting plate 48 is fixed to the rearward end of gas tube 32.

A hot surface igniter assembly 50 is connected to flame retention plate 44 through an opening formed therein. Igniter assembly 50 includes a hot surface element 52 extending from a base portion 54 which is fixed to flame retention plate 44 by means of a connector portion 56. A pair of electrical leads 58, 60 extend from connector portion 56, and are adapted to receive electrical power to energize igniter element 52. Hot surface igniter assembly 50 may be that such as manufactured by the Standard Oil Engineered Materials Company, Electronic Ceramics Division of Niagara Falls, N.Y., under its Part No. 324-500-2004.

A flame sensing rod 62 is mounted to flame retention plate 44 adjacent its outer periphery by means of a base portion 64 and a connector portion 66. An electrical lead 68 is interconnected with flame sensing rod 62.

A deflector plate 70 disposed at an angle of approximately 135° relative to the longitudinal axis of gas tube 32 is fixed to the outer surface of gas tube 32 such as by welding or the like.

The interrelationship of igniter assembly 20 and housing 16 is best shown in FIGS. 1 and 3. As shown, mounting plate 48 is adapted for connection to plate 30 provided at the rearward end of air tube 24, with a gasket 72 disposed therebetween. Gas tube 32 extends through the interior of air tube 24, and is substantially co-axial therewith. Flame retention plate 44 is placed adjacent outlet 26 of air tube 24. A sleeve 74 is adapted for connection to flange 28 mounted at the forward end of air tube 24, and forms the nozzle of power burner assembly 10. A flange gasket 76 is adapted for placement adjacent the forward surface of flange 28, and a sealing gasket 78 is provided about the outer surface of sleeve 74.

With the assembly as shown and described, the operation of power burner assembly 10 is as follows. Pressurized air is supplied to the interior of air tube 24 by means of blower and motor assembly 14, in a known manner. The rearward end of air tube 24 is sealed by means of mounting plate 48 and gasket 72, and pressurized air supplied to air tube 24 passes therefrom through outlet 26 and openings 46 provided in flame retention plate 44. Gas discharged through orifices 38 of orifice member 36 flows radially outwardly therefrom and into the flow path of air passing through flame retention plate passages 46. The mixed air and gas is then ignited by hot surface igniter element 52 so as to generate a flame propogating forwardly of flame retention plate 44.

In operation, igniter assembly 50 is disposed at the top of flame retention plate 44, so as to ensure complete burning of gas discharged through orifices 38. Deflector plate 70 directs air within air tube 24 upwardly toward igniter assembly 50, so as to evenly distribute the flow of air through air tube 24 and flame retention plate 44.

The construction and operation of burner assembly 10 as described provides a simple burner construction of highly efficient and safe operation. Due to its simplicity, the burner assembly provides a low cost of manufacture. Additionally, safe operation is provided because air and gas mix downstream of the flame retention plate, thereby preventing flame flashback. Additionally, air passing through flame retention plate 44 tends to maintain plate 44 cool, notwithstanding the presence of a flame immediately downstream thereof.

Various alternatives and embodiments are contemplated as being within the scope of the following claims particularly pointing out and distinctly claiming the invention.

I claim:

1. A power gas burner assembly, comprising:

a substantially horizontal tubular housing including an air inlet formed in a side thereof;

a blower for supplying pressurized air to said air inlet;

a substantially vertical flame retention plate adapted for placement at one end of said tubular housing and including a plurality of openings therein, said openings outletting pressurized air from said housing;

a mounting plate adapted for placement at the other end of said tubular housing for substantially sealing the other end of said housing;

a gas tube extending through said mounting plate, said housing and said flame retention plate and including a gas outlet disposed downstream of said flame retention plate for discharging gas from said gas tube radially outwardly and into the path of air flowing through the openings in said flame retention plate for mixing gas and air;

a hot surface igniter mounted to the upper portion of said flame retention plate and disposed within the flow path of mixed gas and air for igniting mixed gas and air downstream of said flame retention plate; and an air deflector plate mounted to said gas tube and disposed in the interior of said air tube for directing air flowing through said air tube upwardly toward said hot surface igniter.

2. The assembly of claim 1, wherein said flame retention plate maintains said gas tube in position relative to said housing.

3. The assembly of claim 1, wherein said gas outlet includes an orifice member adapted for connection to the end of said gas tube, said orifice member including a series of passages in communication with the interior of said gas tube, said passages having their longitudinal axes disposed substantially perpendicular to the longitudinal axis of said gas tube immediately upstream of said orifice member and substantially parallel to the plane of said flame retention plate, for discharging gas from said gas tube radially outwardly.

* * * * *